United States Patent [19]

Skagerlund

[11] 4,030,420

[45] June 21, 1977

[54] DEVICE FOR GROUND-CONTROLLED ACTIVATION OF PROXIMITY FUZES

[75] Inventor: Lars-Erik Skagerlund, Karlskoga, Sweden

[73] Assignee: AB Bofors, Bofors, Sweden

[22] Filed: Oct. 15, 1975

[21] Appl. No.: 622,784

[30] Foreign Application Priority Data

Nov. 1, 1974 Sweden ..... 7413757

[52] U.S. Cl. ..... 102/70.2 P

[51] Int. Cl.[2] ..... F42C 13/04; F42C 13/00

[58] Field of Search ..... 102/70.2 P; 244/3.19

[56] References Cited

UNITED STATES PATENTS

| | | | |
|---|---|---|---|
| 3,747,531 | 7/1973 | Powell | 102/70.2 P |
| 3,802,343 | 4/1974 | Dahl | 102/70.2 P |
| 3,844,217 | 10/1974 | Ziemba | 102/70.2 P |

*Primary Examiner*—Verlin R. Pendegrass
*Assistant Examiner*—Thomas H. Webb
*Attorney, Agent, or Firm*—Pollock, VandeSande & Priddy

[57] ABSTRACT

A missile is provided with a proximity fuze arranged to transmit a signal and to receive echoes for activating an explosive charge when an object is within range. A signal processing device located between the receiver of the fuze and the charge is responsive to signals from the receiver and to a blocking signal of predetermined duration, and operates to transmit a control signal for initiating explosion of the charge only if the blocking signal has terminated and a predetermined time interval has elapsed, preceding occurrence of a receiver output signal, during which interval no output signal was produced by the receiver.

10 Claims, 12 Drawing Figures

DEVICE FOR GROUND-CONTROLLED ACTIVATION OF PROXIMITY FUZES

The present invention relates to a device for ground-controlled activation of proximity fuses. fuzes.

The invention is particularly intended for use in a missile which is equipped with a proximity fuze, and the characterizing feature, in principle, of the proximity fuze is that it is arranged to transmit a signal when an object is within a certain distance from the proximity fuze and that it comprises a signal-processing device arranged to transmit a control signal for initiating an explosive charge.

When the missile is used for combatting a target on or near the ground, e.g. low-flying helicopters, there is a great risk that the proximity fuze will be activated and the explosive charge initiated due to reception of ground echoes. When the missile is launched from the ground, during the first part of its trajectory it will continuously receive reflected radiation from the ground surface. In order to prevent the explosive charge from being initiated by these "early" ground echoes, it is known to block the proximity fuze function during a predetermined time after the missile has started. In order that it shall also be possible to combat targets at close range, it is desired that such a delay time should not last longer than necessary. Because of varying terrain conditions, the blocking time will be different in each individual firing case. If a comparatively long blocking time is chosen, there is little risk of initiation from the ground, but then it is not possible to combat targets at close range. If a short time is chosen, targets at close range can be combatted, but at the same time there will be a greater risk of false initiation.

The purpose of the present invention is to achieve a device that eliminates the above-mentioned disadvantages. The invention is mainly characterized in that the signal-processing device is arranged so that, in dependence on the signal from the proximity fuze and a blocking signal, it will transmit an effect signal (i.e., a control signal operative to initiate explosion of the explosive charge in the missile) when the proximity fuze transmits a signal if the conditions have then been fulfilled that the blocking signal has ceased and in connection with or after the cessation of the blocking signal there has been an interval of a certain minimum length of time during which there has been no signal from the proximity fuze.

Figure 1:
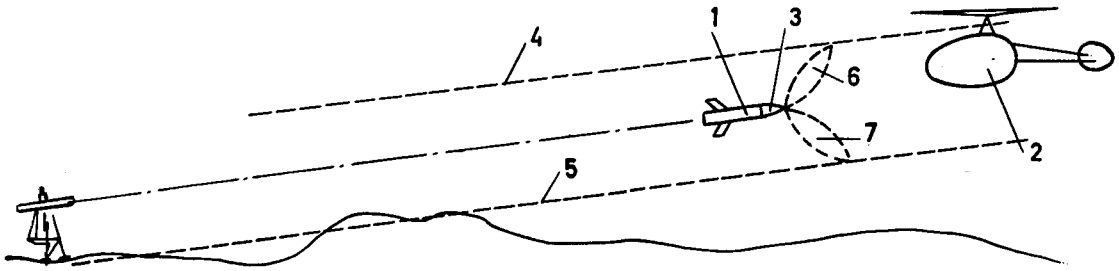
Figure 2:
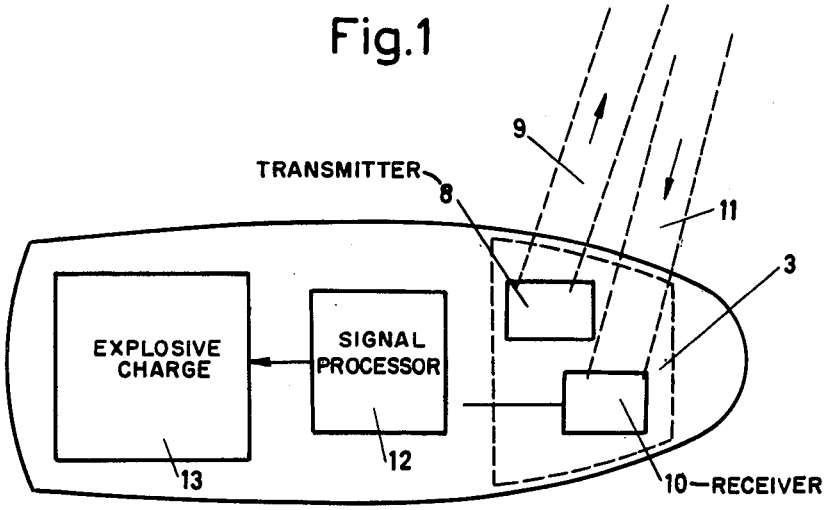

In the following, the invention will be described in more detail with reference to the accompanying drawings, which as examples show different embodiments of the invention, and in which FIG. 1 schematically shows a case of firing of a missile against a target in which the invention is used, FIG. 2 schematically illustrates the mode of functioning of the device, FIGS. 3*a*, 4*a*, 5*a*, 6*a* and 7*a* show block diagrams of different embodiments of the signal-processing device, and FIGS. 3*b*, 4*b*, 5*b*, 6*b* and 7*b* are graph type sequence diagrams of the types of signals that occur at different points in the respective signal-processing devices.

FIG. 1 shows a missile 1 which is fired from the ground against an aerial target, for instance a helicopter 2. In its front part, the missile is provided with a proximity fuze 3, which is arranged to transmit a signal when the target is within a certain distance from the proximity fuze, the range of the proximity fuze. In the FIGURE, the range of the proximity fuze has been indicated with dash lines, 4, 5. The proximity fuze can be equipped with transmitter and receiver devices for electromagnetic radiation, which in a known way are arranged to transmit and receive radiation in certain directions, and with a certain configuration, 6, 7. A target can then be reached by the radiation from the transmitter device of the proximity fuze and reflect part of this radiation back to the receiver device of the proximity fuze which senses if the target is within the range of the proximity fuze. When the missile is fired from the ground, during the first part of the trajectory of the missile, the ground surface will be within the range of the proximity fuze, with the result that the proximity fuze of the missile will continuously give target indication owing to the nearness to the ground surface. Even after the continuous ground echoes have ceased, projecting objects in the terrain can give rise to ground echoes. In previously known proximity fuzes it has not been possible to prevent the initiation of the proximity fuzes in the cases when the blocking signal (see below) which has been applied to the signal-processing device at the firing of the missile has had time to cease.

FIG. 2 shows schematically a missile comprising a proximity fuse 3 according to the invention. The proximity fuze is provided with a transmitter 8 which transmits an electromagnetic beam 9 and a receiver 10 for receiving electromagnetic radiation 11. The transmitter and receiver devices do not constitute a part of the present invention, and can be of conventional kinds. In dependence on the radiation received, the proximity fuze emits a signal to the signal-processing device 12 which, in turn, in dependence on certain conditions which will be described in more detail in the following transmits an effect signal, i.e., a control signal for initiation of the explosive charge 13.

In the following, a number of alternative block diagram solutions of the signal-processing device 12 will be described. In connection with each block diagram, a graph type sequence diagram of the types of signals that occur at different points of the respective block diagram is shown. It has been assumed that the same condition is applicable in the different cases, i.e. that the missile is fired from the ground and during the first part of its trajectory continuously receives reflected radiation and that, when these continuous ground echoes have ceased, projecting objects in the terrain give rise to new ground echoes and that, finally, reflected radiation from a target is received.

Figure 3A:
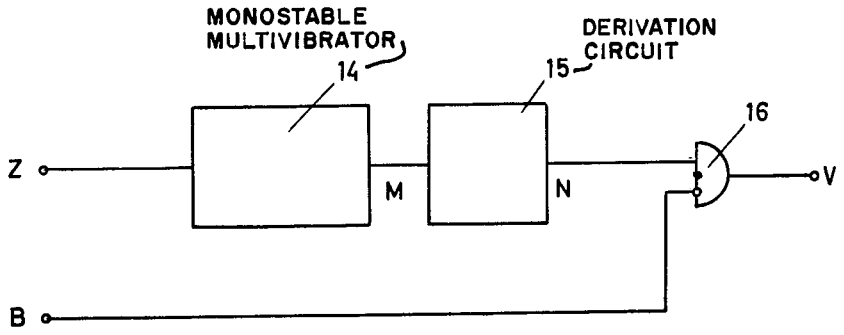

FIG. 3*a* shows a first example of the signal-processing device, which comprises a monostable multivibrator 14. The monostable multivibrator is arranged to trigger in response to a positive going input, and it has been made retriggerable. By its being retriggerable is meant that if the multivibrator receives further trigger signals during its pulse time, the pulse is extended so that the time for its cessation will be related to the last trigger signal. The signal transmitted from the proximity fuze 3 (FIG. 2) is fed to the input Z on the monostable multivibrator 14, and this then emits an output signal M, which remains for a certain time after the input signal has ceased. The output of the monostable multivibrator 14 is connected to a derivation circuit 15 which is arranged to emit a signal N in the form of a pulse with short duration when it is affected by the leading edge of the pulse M emitted from the monostable multivibrator 14. This pulse N is fed to an AND circuit 16 together with a blocking signal, which is fed to the other input B of the signal-processing device. When a signal occurs on the N input of the AND circuit 16 but not on input B, the AND circuit 16 emits an effect signal on the output V.

Figure 3B:
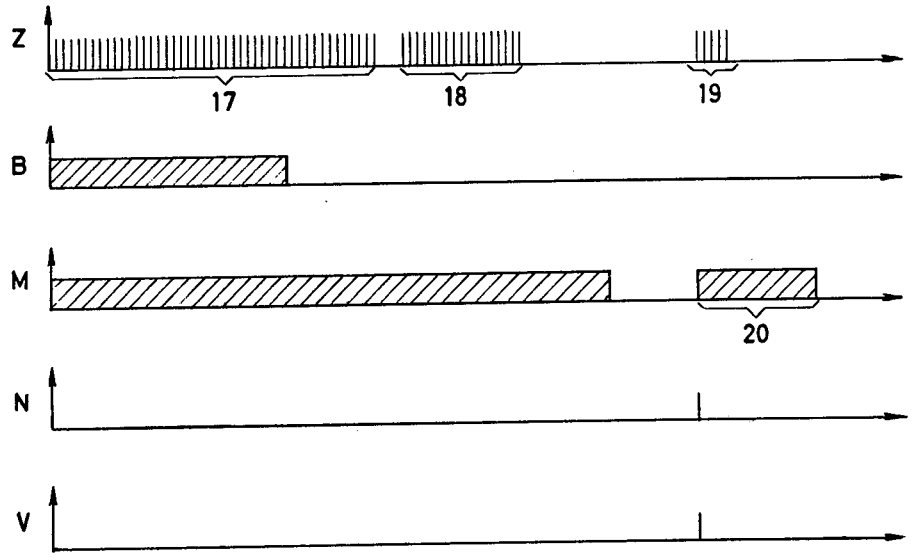

In FIG. 3*b*, which shows a sequence diagram of the types of signals that occur, a further description is given of the function of the signal-processing device in connection with a case in which the missile is fired from the ground against, for instance, a helicopter. The signal transmitted from the proximity fuze is in the form of a pulse train designated Z. This pulse train occurs as soon as an object that can reflect radiation is located within the range of the proximity fuze. It will also be noted that after the continuous ground echoes 17 have ceased, projecting objects in the terrain give rise to ground echoes 18. The blocking signal B is fed to the signal-processing device during the first stage of the missile trajectory for a certain predetermined time interval, which can be set with the aid of a programme mechanism or the like, and is provided in order that ground echoes which occur shall not cause an initiation of the explosive charge. Since the monostable multivibrator 14, as previously mentioned, is retriggerable, the signal M occurs on its output in the form of a sustained pulse when the signal in the form of the pulse train (Z) occurs on its input. The pulse time of the monostable multivibrator is chosen with such a length that short interruptions of the signal received do not break the signal on the output of the multivibrator. When then, for instance, hollow sections in the terrain cause short interruptions of the signal received, the output signal M on the multivibrator will not have time to cease. As the derivation circuit 15 reacts to the leading edge of the pulse emitted by the monostable multivibrator, no control signal will be transmitted. When the proximity fuze has permanently lost the ground contact, the monostable multivibrator returns to its basic condition. When the missile thereafter approaches its target, the helicopter, to such an extent that this has come within the range of the proximity fuze, the signal 19 now received gives rise to a new signal 20 on the output of the multivibrator. When the derivation circuit 15 is now affected by the front edge of the pulse from the monostable multivibrator, a signal, the pulse N, will be emitted from this circuit. As the two conditions for the AND circuit 16 have now been fulfilled, i.e. a signal on input N and no signal on input B, a control signal will be emitted on the output V of the AND circuit, so that the explosive charge 13 (FIG. 2) will be initiated.

Figure 4A:
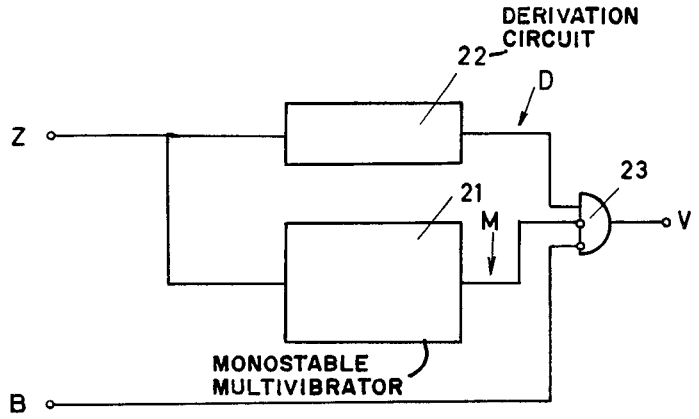

FIG. 4*a* shows a second example of a signal-processing device in which a monostable multivibrator 21 is connected in parallel to a derivation circuit 22. The signal Z emitted from the proximity fuze is fed to both the monostable multivibrator 21 and the derivation circuit 22. The signal-processing device also comprises an AND circuit 23, to the inputs of which the output signals from the monostable multivibrator and the derivation circuit, as well as the blocking signal B are fed. As in the circuit of FIG. 3*a*, the monostable multivibrator 21 has been made retriggerable, but in this case it is arranged to trigger in response to a negative going input.

Figure 4B:
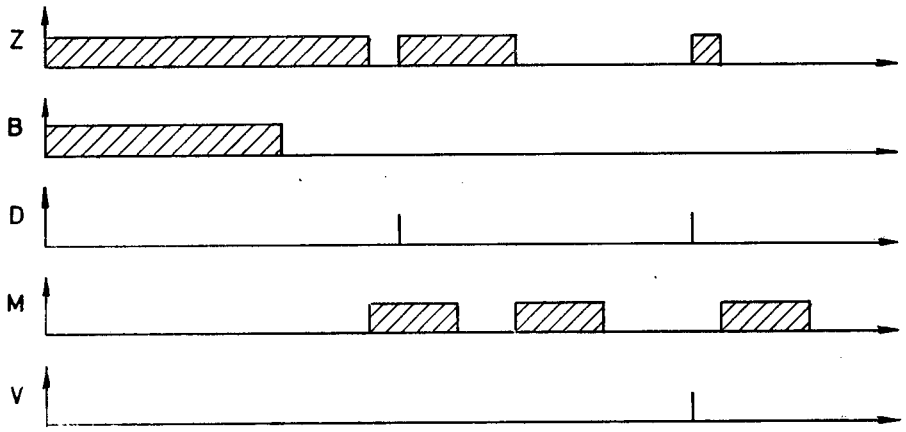

As regards the functioning, reference is made to FIG. 4*b*, in which the signal emitted from the proximity fuze is in the form of a continuous signal designated Z. It will be noted that an effect signal is emitted on the output V of the AND circuit 23 only if there is no blocking signal on input B, if there is no signal on the output M of the monostable multivibrator 21, and there is a signal on the output D of the derivation circuit 22. The last-mentioned signal, in the form of a pulse with short duration, is then emitted as an answer to a positive jump of the signal Z received from the proximity fuze. As will be noted from the diagram, the monostable multivibrator 21 is arranged to transmit a signal M when the input signal ceases and signal M persists for a certain time after the input signal Z has ceased.

Figure 5A:
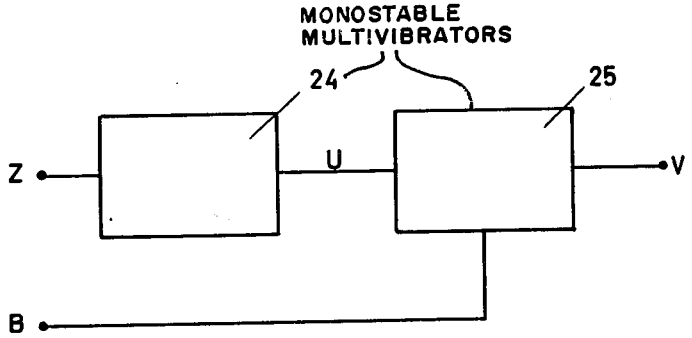
Figure 5B:
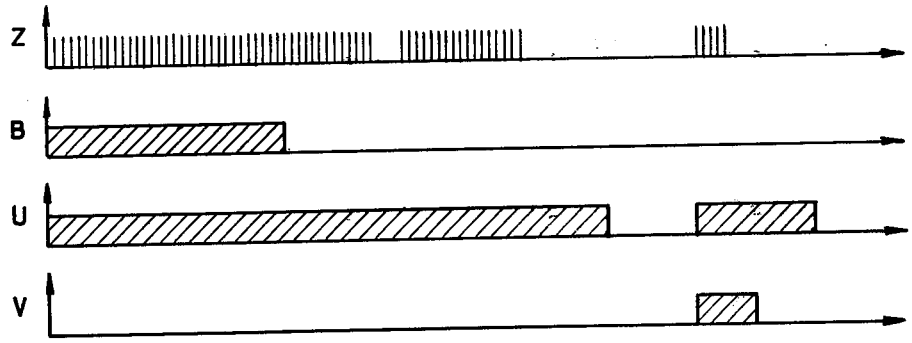

FIG. 5*a* shows a third example of a signal-processing device which comprises two monostable multivibrators 24, 25, connected in series. The second monostable multivibrator 25 is provided with a zero-settting input connected to the blocking input B of the signal-processing device, and both multivibrators are retriggerable, and arranged to trigger in response to a positive going input. The functioning of the circuit is shown in more detail in FIG. 5*b*.

The signal in the form of a pulse train Z, emitted from the proximity fuze, is fed to the input of the first monostable multivibrator 24. An output signal U then occurs on its output, which signal due to the retriggerability remains until a certain time after the last input signal pulse. The second monostable multivibrator 25 is arranged to emit an effect signal V when it is affected by the front edge of the signal on its input U, provided that the multivibrator 25 is not kept in the zero position by the blocking signal B.

Figure 6A:
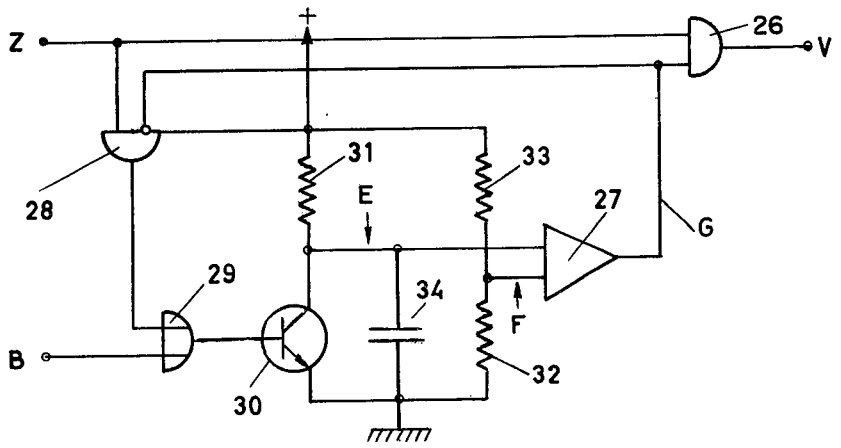
Figure 6B:
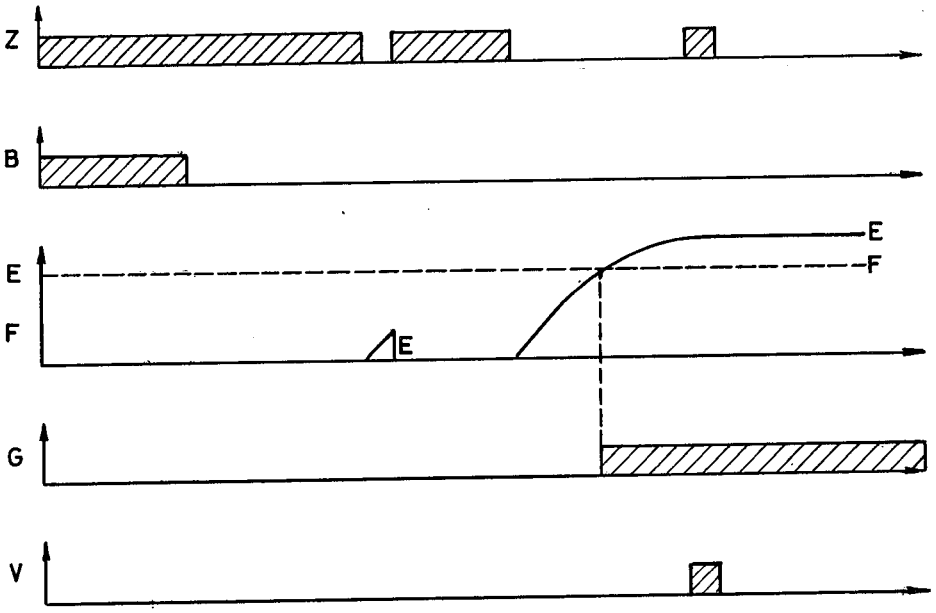

FIG. 6*a* shows a fourth example of a signal-processing device which comprises a first AND circuit 26 which is connected to the Z input of the signal-processing device as well as to the output G of a level comparator 27 and a second AND circuit 28 connected to the input Z as well as to the output of the level comparator 27. The output of the second AND circuit 28 is connected to an OR circuit 29, the second input of which is connected to the blocking input B. The output of the OR circuit 29 is connected to the base of a transistor 30. The collector of the transistor 30 is connected via a resistor 31 to a source of positive voltage, while the emitter is connected to ground. The collector of the transistor 30 is moreover connected to one input of the level comparator 27, the second input of which is connected to ground via the resistor 32 and to the positive voltage via the resistor 33. As previously mentioned, the output of the level comparator 27 is connected to the second input of the first AND circuit 26. Further, a capacitor 34 is connected in parallel across the transistor 30. The function of the circuit will be noted from the sequence diagram in FIG. 6*b*. When the continuous signal Z received from the proximity fuze ceases, in the absence of the blocking signal B, the transistor 30 will be cut off, and the capacitor 34 can then be charged. The voltage E across the capacitor then increases with time according to an exponential function. When the signal Z occurs again on the input of the signal-processing device, the transistor will be rendered conductive, and the voltage E quickly decreases to zero. Whenever there are short interruptions in the received signal Z, the voltage E will not have time to increase so much that it exceeds the reference voltage F across the resistor 32. Therefore, no output signal is emitted from the level comparator 27. When there are longer interruptions of the signal received, however, the capacitor 34 is charged completely, and the voltage E increases to its maximum value and then exceeds the voltage F, with the result that a signal G occurs on the output of the level comparator 27. When a signal Z thereafter again occurs on the input Z of the signal-processing device, a control signal will occur on the output V of the first AND circuit 26, as there are signals on both of its inputs. As will be noted from the diagram, the blocking time is extended somewhat with this variant. Therefore, the duration of the blocking signal B has been shortened correspondingly.

Figure 7A:
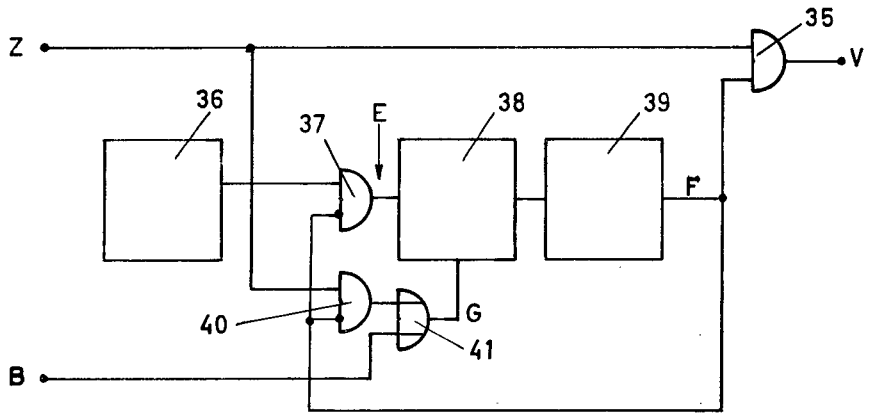
Figure 7B:
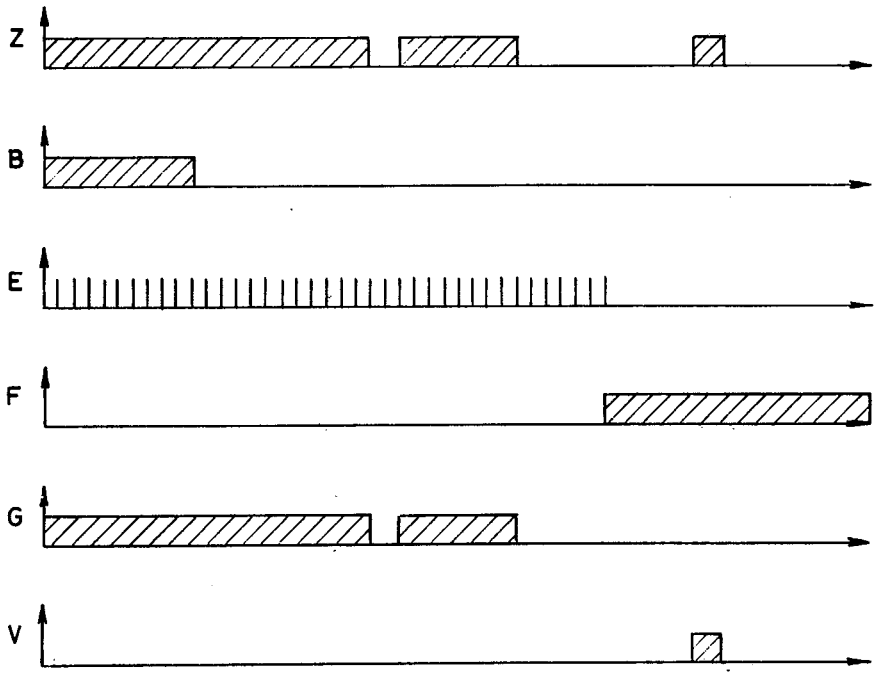

In FIG. 7*a*, finally, a fifth example is shown of how the signal-processing device can be made. This variant comprises an AND circuit 35, one input of which is connected to the Z input of the signal-processing device, and the other input of which is connected to the output F of a delay circuit. The delay circuit comprises an oscillator 36 which via a second AND circuit 37 emits clock pulses to a counter 38, the output of which is connected with a decoder 39. A further AND circuit 40 has one of its inputs connected to the Z input and its second input to the output F of the delay circuit. The output of the AND circuit 40 is connected to an OR circuit 41, the second input of which is connected to the blocking input B, and the output of which is connected to the zero-setting input of the counter 38. The device functions in the following way, see FIG. 7*b*. The oscillator 36 emits clock pulses E to the counter 38 as long as there is no signal on the second input of the second AND circuit 37. No counting takes place as long as there is a signal G on the "zero input" of the counter 38. This signal G occurs both when the blocking signal B is applied and when a signal is received on the Z input of the signal-processing device.

The signal G ceases when the received signal Z ceases. The counter 38 then commences its counting and the decoder 39 is arranged to emit a signal F when the counter 38 has reached a certain predetermined value. The output signal F of the decoder 39 is fed to the two AND circuits 37 and 40 so that the counter then stopping its counting, and signal F is also fed to the AND circuit 35. The next time that the proximity fuze emits a signal Z, the AND circuit 35 will emit a control signal on its output V, as signals occur on both inputs of the AND circuit 35. This variant also extends the blocking time somewhat, and therefore the duration of the blocking signal B has been shortened.

The invention is not limited to the embodiments shown above as examples, but can be subject to modifications within the scope of the following claims.

I claim:

1. The combination of structure comprising a missile carrying an explosive charge, a proximity fuse in said missile, said proximity fuse comprising transmitter means in said missile for radiating energy, the radiated energy being operative upon reflection to produce echo signals, receiver means in said missile responsive to the reception of said echo signals from the ground surface as well as from obstacles on the ground and from a target for producing an output signal, means for producing a blocking signal of predetermined duration commencing with the firing of said missile, and signal processing means in said missile for selectively generating a control signal operative to initiate explosion of said explosive charge in said missile, said signal processing means comprising means for generating said control signal upon occurrence of an output signal from said receiver means, circuit means in said missile responsive to the presence of said blocking signal for inhibiting the generation of said control signal, and timing means in said missile for also inhibiting the generation of said control signal until a predetermined time interval has elapsed, preceding occurrence of a receiver output signal, during which interval no output signal was produced by said receiver means.

2. The combination of structure of claim 1 wherein said signal processing means comprises a monostable multivibrator having an input connected to the output of said receiver means, a derivation circuit connected to the output of said multivibrator, a gating circuit having a first input connected to the output of said derivation circuit, and means coupling said blocking signal to a second input of said gating circuit, said gating circuit being operative to produce said control signal in joint response to the presence of a signal at its said first input and the absence of a signal at its said second input.

3. The combination of structure of claim 2 wherein said multivibrator is of the retriggerable type.

4. The combination of structure of claim 1 wherein said signal processing means comprises a gating circuit, a derivation circuit connected between the output of said receiver means and a first input of said gating circuit, a monostable multivibrator connected between the output of said receiver means and a second input of said gating circuit, and means coupling said blocking signal to a third input of said gating circuit, said gating circuit being operative to produce said control signal in joint response to the presence of a signal at its said first input and the absence of signals at its said second and third inputs.

5. The combination of structure of claim 4 wherein said multivibrator is of the retriggerable type.

6. The combination of structure of claim 1 wherein said signal processing means comprises a first monostable multivibrator having its input connected to the output of said receiver means, a second monostable multivibrator operative to produce said control signal and having its input connected to the output of said first monostable multivibrator, said second multivibrator including a zero-setting input, and means coupling said blocking signal to said zero-setting input.

7. The combination of structure of claim 6 wherein each of said multivibrators is of the retriggerable type.

8. The combination of structure of claim 1 wherein wherein said signal processing means comprises a gating circuit having a first input connected to the output of said receiver means, a delay circuit, means coupling said blocking signal to the input of said delay circuit, and means coupling the output of said delay circuit to a second input of said gating circuit.

9. The combination of structure of claim 8 wherein said delay circuit comprises a capacitor, means responsive to the concurrent absence of said blocking signal and of a signal output from said receiver means for charging said capacitor, and means responsive to the potential across said capacitor for supplying a signal to the second input of said gating means when said potential exceeds a predetermined magnitude.

10. The combination of structure of claim 8 wherein said delay circuit comprises a source of clock pulses, a counter, means responsive to the concurrent absence of said blocking signal and of a signal output from said receiver means for coupling said source to said counter, and means coupled to said counter for supplying a signal to the second input of said gating means when said counter reaches a predetermined count.

* * * * *